US005398546A

United States Patent [19]

Jeffryes

[11] Patent Number: 5,398,546

[45] Date of Patent: Mar. 21, 1995

[54] DETERMINATION OF DRILL BIT RATE OF PENETRATION FROM SURFACE MEASUREMENTS

[75] Inventor: Benjamin P. Jeffryes, Histon, England

[73] Assignee: Schlumberger Technology Corporation, Sugar Land, Tex.

[21] Appl. No.: 98,669

[22] Filed: Jul. 28, 1993

[30] Foreign Application Priority Data

Aug. 6, 1992 [GB] United Kingdom ..... 9216740

[51] Int. Cl.[6] ..... E21B 47/00

[52] U.S. Cl. ..... 73/151.5

[58] Field of Search ..... 73/151.5; 364/420; 175/5, 7

[56] References Cited

U.S. PATENT DOCUMENTS

| | | | |
|---|---|---|---|
| 2,330,753 | 9/1943 | Sikes, Jr. | 73/151.5 |
| 2,688,871 | 9/1954 | Lubinski | 73/151.5 |
| 3,777,560 | 12/1973 | Giugnard | 73/151.5 |
| 3,853,004 | 12/1974 | Westlake et al. | 73/151.5 |
| 3,881,695 | 5/1975 | Joubert | 73/151.5 |
| 3,891,038 | 6/1975 | Delestrade et al. | 73/151.5 |
| 3,931,735 | 1/1976 | Guigmard | 73/151.5 |
| 4,085,509 | 4/1978 | Bell et al. | 73/151.5 |
| 4,736,297 | 4/1988 | LeJeune | 364/420 |
| 4,843,875 | 7/1989 | Kerbart | 73/151.5 |
| 4,852,052 | 7/1989 | Frey et al. | 73/151.5 |

FOREIGN PATENT DOCUMENTS

| | | |
|---|---|---|
| 2038700 | 1/1971 | France . |
| 1441005 | 6/1976 | United Kingdom . |

*Primary Examiner*—Hezron E. Williams
*Assistant Examiner*—Michael J. Brock
*Attorney, Agent, or Firm*—Wayne I. Kanak

[57] ABSTRACT

A method of determining, from surface measurements, the rate of penetration Δd of a drill bit attached to a drill string suspended from a floating drilling rig by means of a suspension system and a motion compensator, the method comprising:

a) determining a displacement Δs of the drill string at the surface;

b) determining from the measurements a function Λ′ of drill string compliance Λ such that $\Lambda' = \Lambda(1-\theta)$ (wherein θ is a contribution factor of the motion compensator to an axial force applied to the drill string at the surface);

c) determining an axial force ΔT in the suspension system applied at the surface;

d) determining a vertical displacement ΔM of the motion compensator;

e) determining from the measurements a function μ of the motion compensator compliance $\lambda_M$ such that $$\mu = \frac{\Lambda\theta}{\lambda_m};$$

and f) calculating the bit displacement Δd from the relationship $$\Delta d = \Delta s - \Lambda'\Delta T - \mu\Delta M.$$

4 Claims, 3 Drawing Sheets

DETERMINATION OF DRILL BIT RATE OF PENETRATION FROM SURFACE MEASUREMENTS

BACKGROUND OF THE INVENTION

1. Field of the Invention

The present invention relates to a method of determining the rate of penetration (ROP) of a drill bit from measurements made at the surface while drilling from a floating rig.

2. Description of the Related Art

In the rotary drilling of wells such as hydrocarbon wells, a drill bit is located at the end of a drill string formed from a number of hollow drill pipes attached end to end which is rotated so as to cause the bit to drill into the formation under the applied weight of the drill string. The drill string is suspended from a hook and as the bit penetrates the formation, the hook is lowered so as to allow the drill string to descend further into the well. The ROP has been found to be a useful parameter for measuring the drilling operation and provides information about the formation being drilled and the state of the bit being used. Traditionally, ROP has been measured by monitoring the rate at which the drill string is lowered into the well at the surface. However, as the drill string, which is formed of steel pipes, is relatively long the elasticity or compliance of the string can mean that the actual ROP of the bit is considerably different to the rate at which the string is lowered into the hole. The errors which can be caused by this effect become progressively larger as the well becomes deeper and the string longer, especially if the well is deviated when increased friction between the string and the borehole wall can be encountered.

Certain techniques have been proposed to overcome these potential problems. In U.S. Pat. No. 2,688,871 and U.S. Pat. No. 3,777,560 the drill string is considered as a spring and the elasticity of the string is calculated theoretically from the length of the drill string and the Young's modulus of the pipe used to form the string. This information is then used to calculate ROP from the load applied at the hook suspending the drill string and the rate at which the string is lowered into the well. These methods suffer from the problem that no account is taken of the friction encountered by the drill string as a result of contact with the wall of the well. FR 2038700 proposes a method to overcome this problem in which the modulus of elasticity is measured in situ. This is achieved by determining the variations in tension to which the drill string is subjected as the bit goes down the well until it touches the bottom. Since it is difficult to determine exactly when the bit touches the bottom from surface measurements, strain gauges are provided near the bit and a telemetry system is required to relay the information to the surface. This method still does not provide measurements when drilling is taking place and so is inaccurate as well as difficult to implement.

A method is proposed in U.S. Pat. No. 4,843,875 (incorporated herein by reference) in which ROP is measured from surface measurements while drilling is taking place. This method uses the following model:

$$\Delta d = \Delta s + \Lambda \Delta h$$

wherein d is the downhole displacement, s is the surface displacement, $\Lambda$ is the drill string compliance and h is the axial force at the surface. $\Delta$ is the difference operator taken over some time interval $\tau$. Using the assumptions that over any time interval $\tau$ (typically 5 minutes) drilling is at an average constant weight on bit (WOB), that the lithology does not change significantly, and the drill string behaves as a perfect spring, then a least squares regression is used to obtain an estimate of $\Lambda$. In a plot of $\Delta s$ against $\Delta h$, $\Lambda$ is the slope of the best fit line through the data points. The derived value of $\Lambda$ can be substituted back into the model to give ROP which can then be integrated to give hole depth. The choice of $\tau$ and $\tau'$ may be optimised with field experience. Implementation of this approach means that the drill string compliance is only updated at a time interval of $\tau'$ and control logic must be incorporated to ensure that the required assumptions are true. If this cannot be done, calculation of compliance must be suspended.

Our co-pending British Patent Application Number 9203844.7 provides a method of determining ROP from surface measurements which can be used where the approach outlined above is undesirable or inappropriate, comprising determining a state space description of the vertical displacement and determining $\Delta d$ using Kalman filtering.

When drilling from floating rigs, problems are encountered in the measurement of $\Delta h$ which is required for the determination of $\Delta d$ in the above described methods. Floating drilling rigs such as drill ships or semi-submersible rigs are subjected to vertical or "heave" motion due to the action of waves on the floating structure. The effect of heave would be to vary the weight applied to the bit by the driller and in extreme circumstances might lift the bit off the bottom of the hole or apply too much weight and cause damage to the bit. In any event, this motion complicates progress of the drilling process. In order to overcome this problem, motion compensators are used in the connection between the drill string and the rig which operate to compensate for the heave motion and allow the weight on bit to be controlled more accurately. However, these compensators do not remove heave effects completely and so there is still potential inaccuracy in the ROP determination.

It is an object of the present invention to provide an improved ROP determination from floating rigs when drilling using a motion compensator. The term "motion compensator" is intended to cover any device interposed between the drill string and the derrick or mast for the purpose of compensating the vertical motion of a floating rig.

SUMMARY OF THE INVENTION

In accordance with a first aspect of the invention, there is provided a method of determining, from surface measurements, the rate of penetration $\Delta d$ of a drill bit attached to a drill string suspended from a floating drilling rig by means of a suspension system and a motion compensator, the method comprising:

a) determining a displacement $\Delta s$ of the drill string at the surface;

b) determining a function of drill string compliance $\Lambda$ from the measurements;

c) determining an axial force $\Delta T$ in the suspension system applied at the surface;

d) determining a vertical displacement $\Delta M$ of the motion compensator;

e) determining a function of the motion compensator compliance $\lambda_M$ from the measurements; and f) calculating the bit displacement $\Delta d$ from the relationship:

$$\Delta d = \Delta s - \Lambda\left[(1-\theta)\Delta T + \theta\frac{1}{\lambda_M}\Delta M\right]$$

wherein $\theta$ is a contribution factor of the motion compensator to an axial force applied to the drill string at the surface.

Preferably $\Delta T$ comprises the hookload which can conveniently be measured from the deadline anchor tension. As can be determined from a measurement of a riser slip joint displacement plus travelling block height minus motion compensator displacement $\Delta M$.

The present invention has the advantage that two parameters are measured which each relate to the hookload such as the deadline anchor tension and motion compensator displacement, thus improving the $\Delta d$ determination.

A second aspect of the invention utilises a state space description of the process $$\Delta d = \Delta s - \Lambda'\Delta T - \mu\Delta M$$

wherein $$\Lambda' = \Lambda(1-\theta)$$

$$\mu = \frac{\Lambda\theta}{\lambda_m}$$

and comprises a measurement equation $$\Delta s = [1\,\Delta T\,\Delta M]\begin{bmatrix}\Delta d\\ \Lambda'\\ \mu\end{bmatrix} + \rho$$

and a state evolution equation $$\begin{bmatrix}\Delta d\\ \Lambda'\\ \mu\end{bmatrix}_{j+1} = \begin{bmatrix}1 & 0 & 0\\ 0 & 1 & 0\\ 0 & 0 & 1\end{bmatrix}\begin{bmatrix}\delta d\\ \Lambda'\\ \mu\end{bmatrix}_j + r$$

and applies Kalman filtering to obtain an estimate of the state parameters including $\Delta d$.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
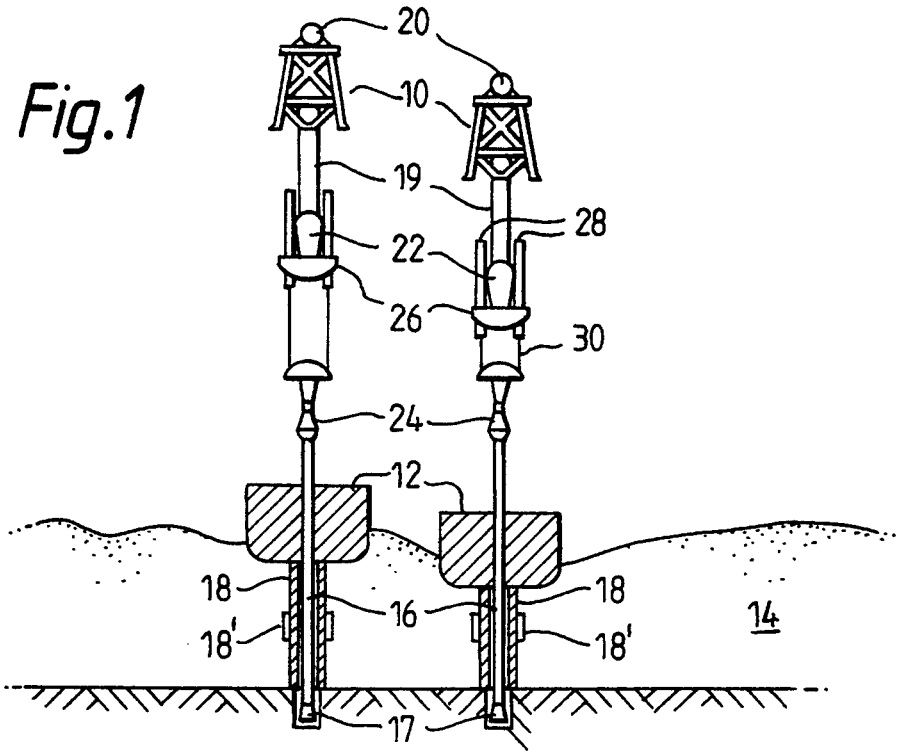
FIG. 1 shows a schematic view of a drilling operation from a floating rig such as a drill ship.

Referring now to the drawings, FIG. 1 shows two views of a schematic representation of a floating drilling rig (drill ship) which illustrate the effect of a heave compensator. In the example shown in FIG. 1, the derrick 10 (shown in part) is mounted on the hull 12 of the vessel which is floating in the sea 14 and is allowed to move vertically with wave motion. The drill string 16, having a drill bit 17 at the end thereof, extends from the drill floor on the hull into the sea bed and generally passes through a marine riser 18 having a slip joint 18' which allows drilling mud to be returned to the surface. The drill string 16 is carried by a suspension system comprising a cable 19, a crown block 20 and a travelling block 22 and the drill string 16 is suspended on a hook 24 as in conventional land drilling operations. However, in the present case, a heave compensator 26 is interposed between the hook 24 and the travelling block 22. The compensator 26 comprises hydraulic cylinders 28 connected to tensioning cables 30 which support the hook 24 and allow the vertical motion of the hull to be eliminated by automatically adjusting the length of the cables 30. In the floating rig system described above, the motion compensator acts as a very soft spring, the displacement of which is nearly proportional to the load on the spring. Thus, if the spring constant of the motion compensator is known, the hookload can be deduced. However, since the motion compensator is not designed as a force transducer it does not provide a totally linear response as there are effects due to velocity dependent damping and Coulomb friction. Despite this the motion compensator, directly attached to the hook, is in an ideal position to act as a force transducer since the force it responds to is the force on the hook. A load cell attached to the deadline anchor is a better measuring device as the output is almost linearly proportional to the anchor tension. The anchor tension is coloured by the effects of friction in the sheaves, the inertia of the travelling block and other sources of noise.

Given the two separate measurements (motion compensator displacement and anchor tension) each of which is proportional to the hookload but with the addition of noise, a linear combination of the two will also be proportional to the hookload but the relative magnitude of the noise will be changed. If two identical sensors were used with uncorrelated noise, taking the mean of the two measurements would enhance the signal to noise ratio.

If in this case the best linear combination to take is $$\Delta h = \left[(1-\theta)\Delta T + \theta\frac{1}{\lambda_m}\Delta M\right]$$

(where $\Delta T$ is the change in deadline-anchor tension, $\Delta M$ is the change in motion compensator displacement, $\lambda_M$ is the compliance of the motion compensator and $\theta$ is an additional parameter), then equation may be rewritten as $$\Delta d = \Delta s - \Lambda\left[(1-\theta)\Delta T + \theta\frac{1}{\lambda_M}\Delta M\right]$$

$\Delta s$ on a floating rig comes from the riser slip joint displacement, plus the travelling block height, minus the motion compensator displacement.

Setting $$\mu = \frac{\Lambda\theta}{\lambda_M}$$

then $$\Delta d = \Delta s - \Lambda\Delta T - \mu\Delta M$$

In order to estimate $\Delta d$ only the linear combination of parameters $\Lambda$ and $\mu$ need to be found. Using least squares multiple linear regression the parameters $\Lambda$ and $\mu$ may be calculated using $$\begin{pmatrix} \Lambda' \\ \mu \\ \overline{\Delta d} \end{pmatrix} = \begin{pmatrix} \sum_{j=1}^{N}(\Delta T_j)^2 & \sum_{j=1}^{N}(\Delta T_j \Delta M_j) & \sum_{j=1}^{N}\Delta T_j \\ \sum_{j=1}^{N}(\Delta T_j \Delta M_j) & \sum_{j=1}^{N}(\Delta M_j)^2 & \sum_{j=1}^{N}\Delta M_j \\ \sum_{j=1}^{N}\Delta T_j & \sum_{j=1}^{N}\Delta M_j & N \end{pmatrix}^{-1} \begin{pmatrix} \sum_{j=1}^{N}(\Delta s_j \Delta T_j) \\ \sum_{j=1}^{N}(\Delta s_j \Delta M_j) \\ \sum_{j=1}^{N}\Delta s \end{pmatrix}$$

$\overline{\Delta d}$ is the average value of $\Delta d$ over the N samples.

A possible state space model, similar to that proposed in GB 9203844.7 comprises the measurement equation $$\Delta s = [1 \Delta T \, \Delta M] \begin{bmatrix} \Delta d \\ \Lambda' \\ \mu \end{bmatrix} + \rho$$

and a state evolution equation $$\begin{bmatrix} \Delta d \\ \Lambda' \\ \mu \end{bmatrix}_{j+1} = \begin{bmatrix} 1 & 0 & 0 \\ 0 & 1 & 0 \\ 0 & 0 & 1 \end{bmatrix} \begin{bmatrix} \delta d \\ \Lambda' \\ \mu \end{bmatrix}_j + r$$

Figure 2:
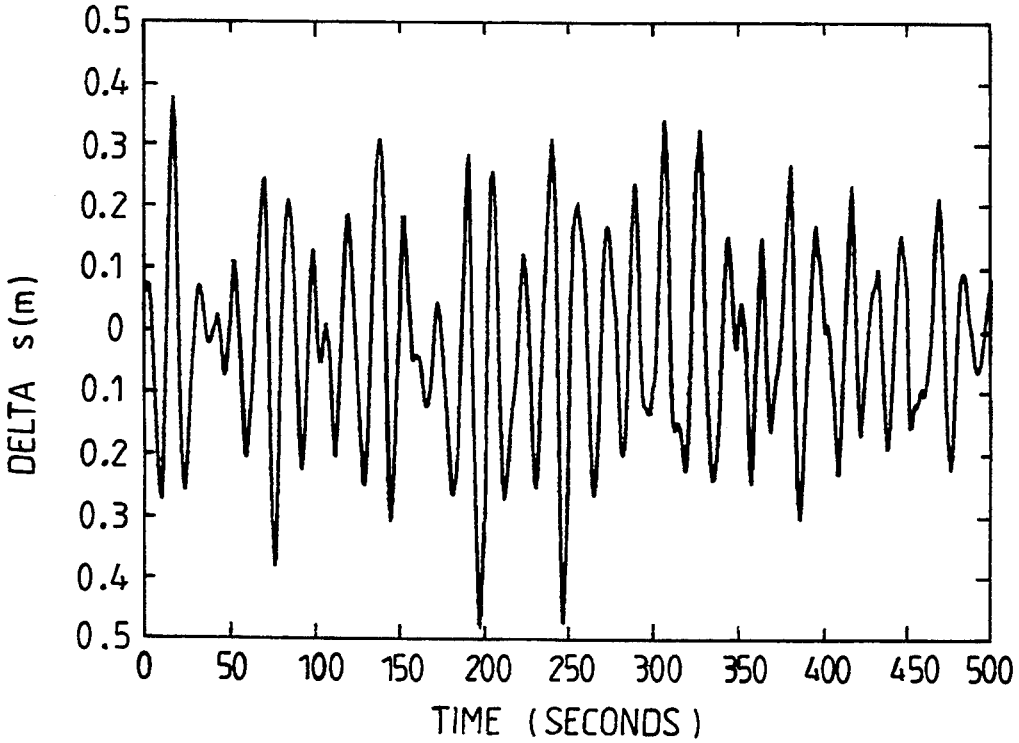
FIG. 2 shows a plot of $\Delta s$

FIG. 2 shows $\Delta s$ over a 500 second period while drilling at about 5 feet/hour (0.025 m/minute). $\tau$ is 60 seconds. Despite the motion compensator the effects of heave dominate in the surface displacement, because the drillstring acts as a spring in series with the motion compensator.

Figure 3:
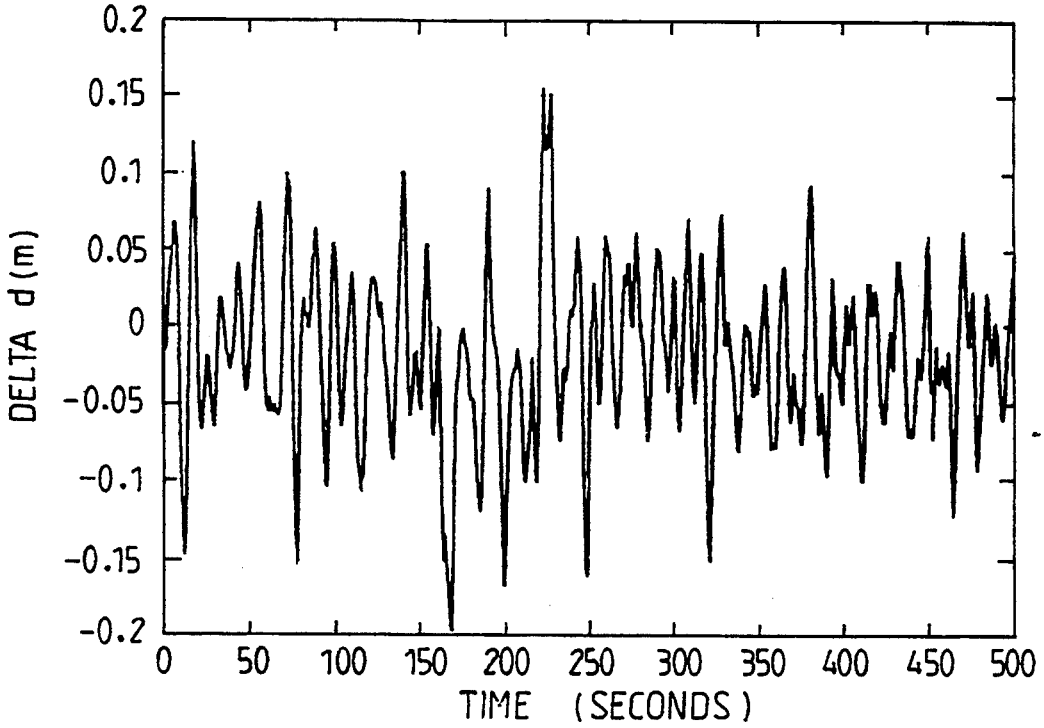
Fig.3 (Prior Art)
FIG. 3 shows a plot of $\Delta d$ calculated according to the prior art method.
Figure 4:
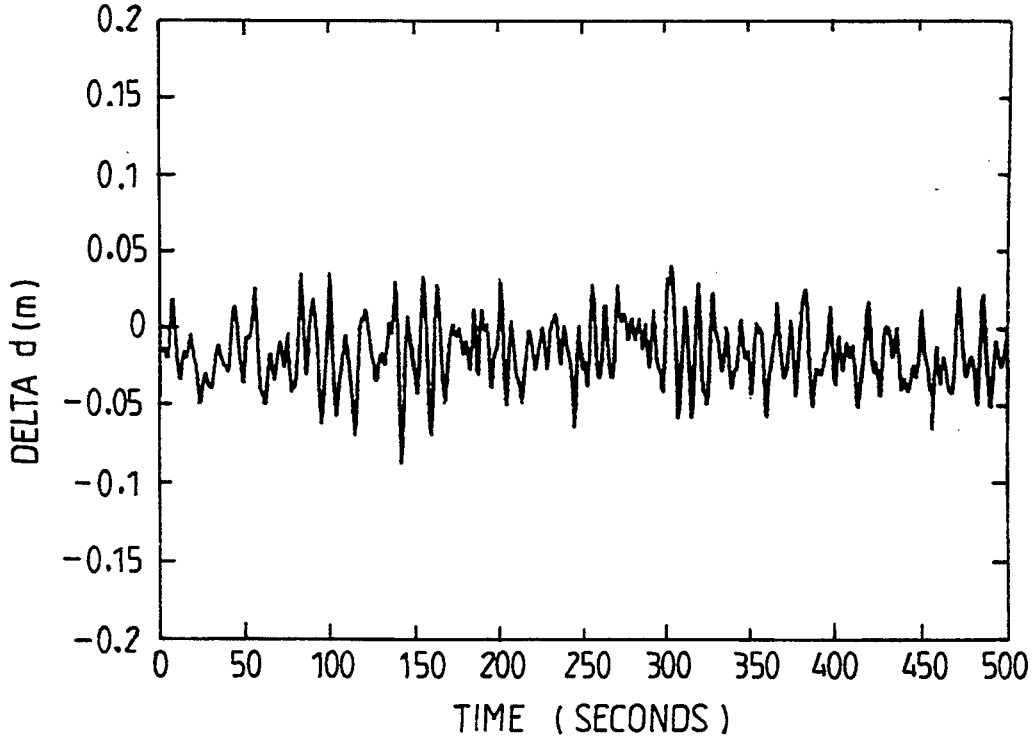
FIG. 4 shows a plot of $\Delta d$ calculated by a method according to a first aspect of the present invention.
Figure 5:
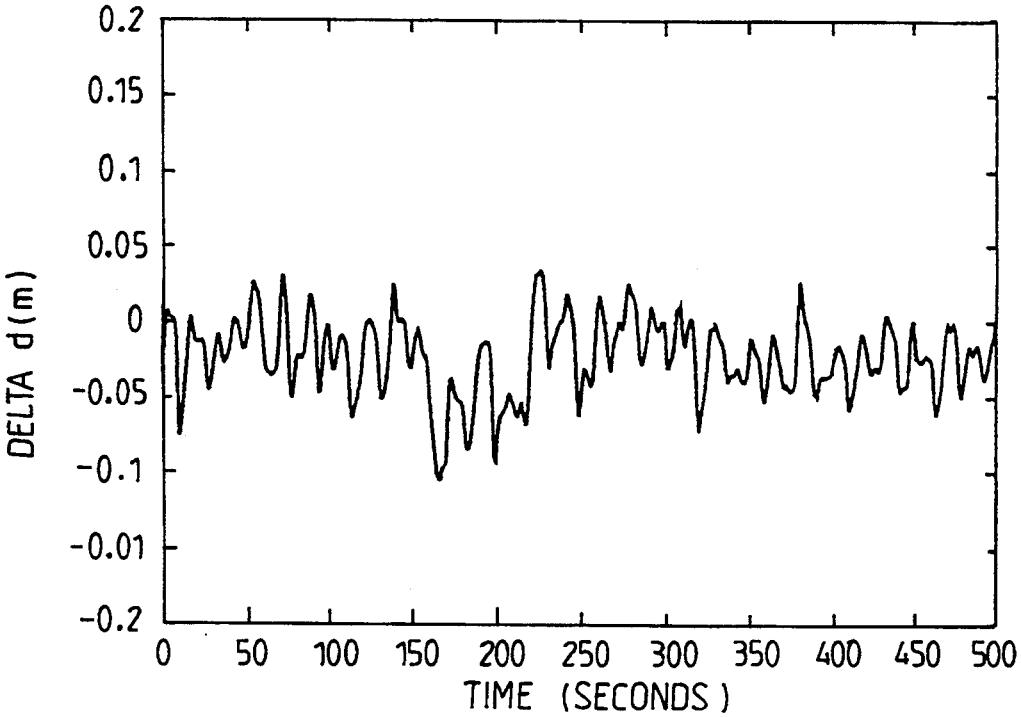
FIG. 5 shows a plot of $\Delta d$ calculated according to a second aspect of the present invention.
Figure 6:
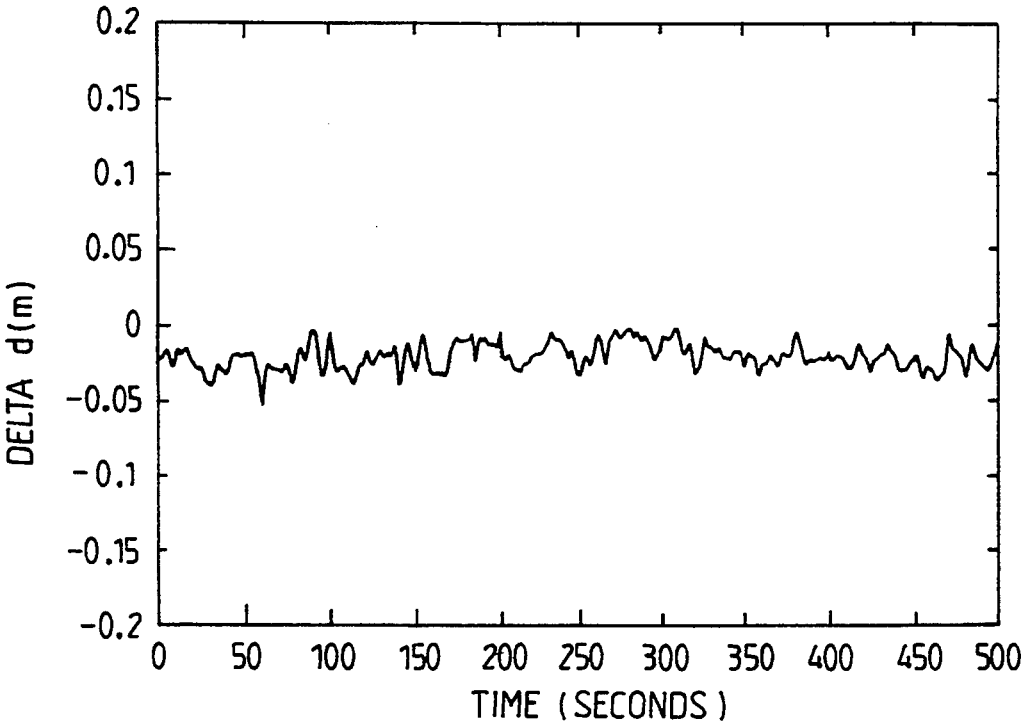
FIG. 6 shows a plot of $\Delta d$ calculated using a state space model and Kalman filtering.

FIG. 3 shows $\Delta d$ calculated using the prior art method. Most of the heave has been removed, but the residual amplitude over one minute is still much larger than the distance drilled. FIG. 4 shows $\Delta d$ calculated according to a first aspect of the present invention. The improvement is obvious, in particular spurious positive displacements are greatly reduced. Using the state space method according to the present invention results in the estimate of change in downhole displacement shown in FIG. 5. The positive displacements are reduced similarly to those in FIG. 4. Finally FIG. 6 shows the full benefits of using Kalman filtering with both deadline-anchor tension and motion compensator displacement measurements. The true downhole rate of penetration has been made apparent.

The present invention provides a method by which ROP estimation on floating figs with travelling-block motion compensation can be improved by using both the conventional hookload measurement and the compensator displacement in the calculation. A particularly good result is obtained using a state space model and Kalman filtering. The method may also be applied to floating rigs fitted with crown block motion compensators, although the improvement in estimation would not be so great, as the compensator is further from the drillstring. More generally on any drilling rig, if there is more than one distinct measurement nearly proportional to the hookload then this method can be applied.

The particular choice of state space model described above was chosen so as to produce results directly comparable with the results using linear regression. Alternative measurement and state evolution equations can be used that do not require differencing over the time interval $\tau$.

I claim:

1. A method of determining, from surface measurements, the rate of penetration $\Delta d$ of a drill bit attached to a drill string suspended from a floating drilling rig by means of a suspension system and a motion compensator, the method comprising:

a) determining a displacement $\Delta s$ of the drill string at the surface;

b) determining from the measurements a function $\Lambda'$ of drill string compliance $\Lambda$ such that $\Lambda' = \Lambda(1-\theta)$ (wherein $\theta$ is a contribution factor of the motion compensator to an axial force applied to the drill string at the surface);

c) determining an axial force $\Delta T$ in the suspension system applied at the surface;

d) determining a vertical displacement $\Delta M$ of the motion compensator;

e) determining from the measurements a function $\mu$ of the motion compensator compliance $\lambda_M$ such that $$\mu = \frac{\Lambda\theta}{\lambda_M};$$

and f) calculating the bit displacement $\Delta d$ from the relationship $$\Delta d = \Delta s - \Lambda'\Delta T - \mu\Delta M.$$

2. A method as claimed in claim 1, comprising determining $\Lambda'$ and $\mu$ by defining a measurement equation $$\Delta s = [1 \Delta T \, \Delta M] \begin{bmatrix} \Delta d \\ \Lambda' \\ \mu \end{bmatrix} + \rho$$

and a state evolution equation $$\begin{bmatrix} \Delta d \\ \Lambda' \\ \mu \end{bmatrix}_{j+1} = \begin{bmatrix} 1 & 0 & 0 \\ 0 & 1 & 0 \\ 0 & 0 & 1 \end{bmatrix} \begin{bmatrix} \delta d \\ \Lambda' \\ \mu \end{bmatrix}_{j} + r$$

and applying Kalman filtering to obtain an estimate of the state parameters $\Delta d$, $\Lambda'$ and $\mu$.

3. A method as claimed in claim 1, comprising measuring deadline anchor tension in a cable forming pan of the suspension system to determine $\Delta T$.

4. A method as claimed in claim 1, comprising determining $\Delta s$ from a measurement of a riser slip joint displacement plus a measurement of height of a travelling block in the suspension system minus motion compensator displacement $\Delta M$.

* * * * *